US006029401A

United States Patent [19]

Gale

[11] Patent Number: 6,029,401

[45] Date of Patent: Feb. 29, 2000

[54] PANEL MOUNTING ASSEMBLY

[76] Inventor: Donald H. Gale, 3404 Centenary, Dallas, Tex. 75225

[21] Appl. No.: 09/166,382

[22] Filed: Oct. 5, 1998

[51] Int. Cl.[7] ..... E05C 21/02

[52] U.S. Cl. ..... 49/465

[58] Field of Search ..... 49/463, 465, 57, 49/61

[56] References Cited

U.S. PATENT DOCUMENTS

| | | | |
|---|---|---|---|
| 172,511 | 1/1876 | Simpson et al. . | |
| 288,921 | 11/1883 | Chamberlin . | |
| 530,353 | 12/1894 | Schill . | |
| 569,073 | 10/1896 | Way . | |
| 671,727 | 4/1901 | Hipolito et al. . | |
| 934,059 | 9/1909 | Ferguson . | |
| 1,409,050 | 3/1922 | Jurisch . | |
| 1,798,187 | 3/1931 | Brouillette . | |
| 1,825,538 | 9/1931 | Pace . | |
| 2,225,963 | 12/1940 | Augustine . | |
| 2,595,595 | 5/1952 | McKay . | |
| 2,612,947 | 10/1952 | Jenks . | |
| 2,772,451 | 12/1956 | Luke . | |
| 3,098,611 | 7/1963 | Connell . | |
| 3,360,910 | 1/1968 | Soltis | 49/463 X |
| 3,468,058 | 9/1969 | Fontaine | 49/463 X |
| 5,568,832 | 10/1996 | Eddy . | |

*Primary Examiner*—Jerry Redman
*Attorney, Agent, or Firm*—Welsh & Katz, Ltd.

[57] ABSTRACT

A mounting assembly for mounting a panel, such as a shutter, adjacent and in parallel, spaced relation to a window set into a window frame that has first and second opposing walls includes a biased mount and a fixed mount attached to the panel in opposing relation to one another. The biased mount has a body fixedly attached to a surface of the panel at about an edge thereof. A reciprocating biasing assembly is carried by the body and includes a shaft operably connected to the body by a biasing element. The shaft has a first engaging element mounted to an end thereof that is movable away from and toward a selected one of the first and second walls of the window frame. The biasing assembly biases the engaging element toward the selected wall. The fixed mount has a body fixedly attached to the surface of the panel in opposing, spaced relation to the biased mount. The fixed mount has a second engaging element operably mounted thereto for engaging the opposing wall of the window frame in a direction generally opposing the first engaging element. When the panel is positioned at the window frame with the biased and fixed mounts engaging opposing walls of the window frame, the panel is secured in place between the walls by the first and second engaging elements in contact with their respective walls and by a force exerted by the biasing element on the first engaging element.

4 Claims, 4 Drawing Sheets

FIG. 3
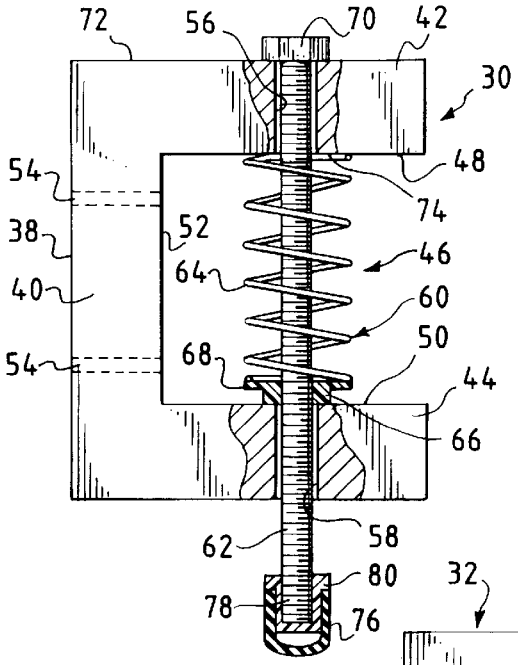
FIG. 4
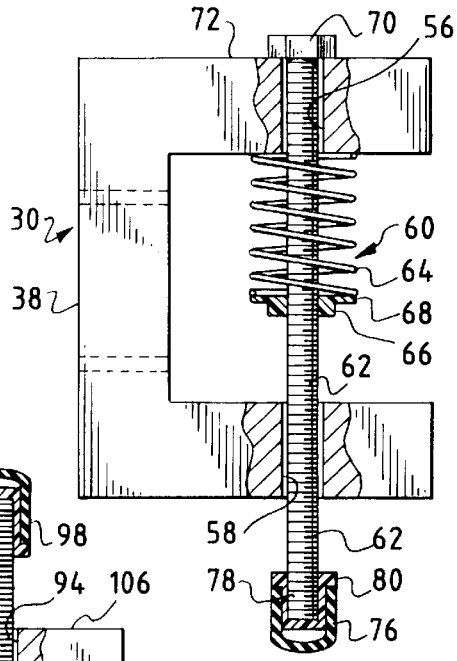
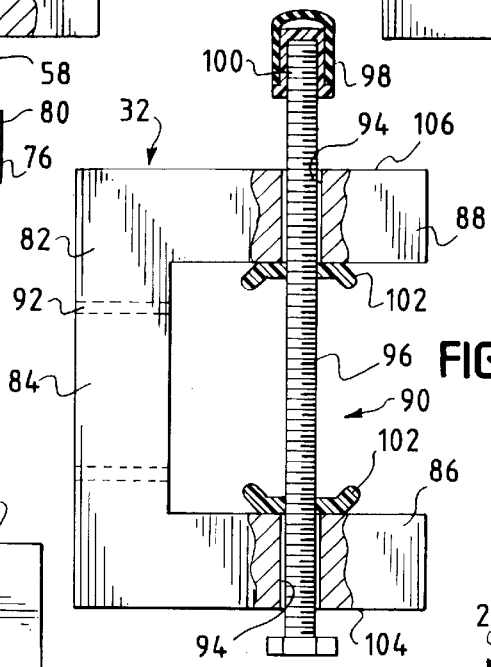
FIG. 5
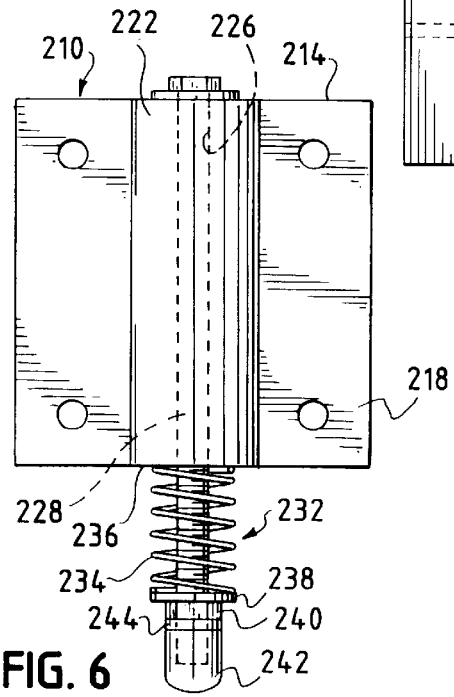
FIG. 6
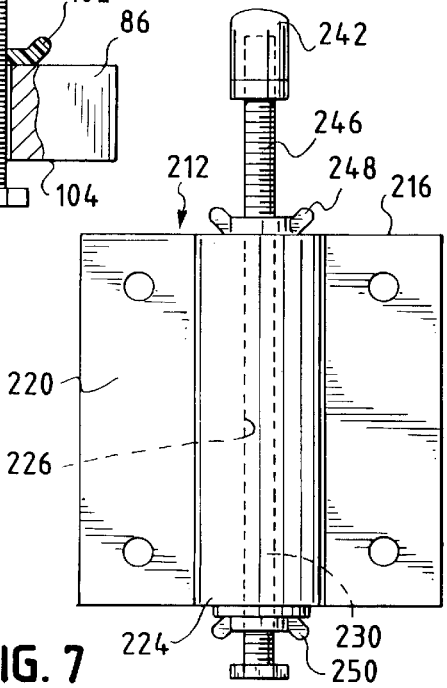
FIG. 7

PANEL MOUNTING ASSEMBLY

FIELD OF THE INVENTION

This invention pertains to a mounting assembly for panels such as shutters. More particularly, this invention pertains to a spring-biased panel mounting assembly for readily installing panels in single-panel and multi-panel arrangements.

BACKGROUND OF THE INVENTION

It is believed that clear glass, such as that used for making windows, date back to the early periods of the Roman Empire or even earlier times. Since the manufacture of clear glass and its use in windows, occupants of buildings have sought ways to maintain privacy, and to block or defuse light through these windows. To this end, interior window treatments were developed to prevent people on the outside from looking in, as well as to block the admission of, or diffuse incoming light.

Although a tremendously wide variety of window treatments is available, one common type of window treatment is panels such as shutters. Window shutters can be decorative, functional or both. They can be installed on an exterior surface of a building for aesthetics, or to provide protection from, for example storms and hurricanes. Shutters can also be installed in an interior portion of a building to add aesthetic appeal, and if finctional, to provide privacy and to permit the adjustment of the amount of light entering through the window from the outside.

Those familiar with shutters will recognize that shutters can be quite costly to purchase and install. This is particularly true for plantation shutters, which are generally recognized as shutters that have deep slats, generally about 2 inches or more deep. Typically, the installation of plantation shutters is a rather labor-intensive, and expertise-intensive undertaking that is beyond the knowledge and skill of most "do it yourself" homeowners.

In a typical installation, either a frame is built and installed within the window box to support the shutters, or "hanging strips" are installed along the sides of the window box from which the shutters are hung. Although either method can appear to be a relatively straight forward task, each requires skill, not only in measuring and laying-out the shutters, but particularly in the actual physical installation of the shutters.

Moreover, if measurements are not made accurately and properly, the shutters may not properly fit within the window box or frame. Ill-fitting and improperly installed shutters can greatly detract from an otherwise aesthetically appealing window treatment design. To this end, the installation of plantation shutters is generally carried out by professional installers, which necessarily increases the cost for this type of window treatment.

Accordingly, there exists a need for a shutter mounting arrangement that permits ready installation of shutters by both professionals and "do it yourself" homeowners. Desirably, such a mounting arrangement is sufficiently "forgiving" so that inexact measurements and designs can be accommodated within the mounting process, without detracting from the function and aesthetic appeal of the shutter design.

SUMMARY OF THE INVENTION

A mounting assembly for mounting a panel, such as a shutter, a decorative, transparent or translucent screen or opaque panel, adjacent and in parallel, spaced relation to a window set into a window frame having opposing walls, provides an arrangement by which such panels can be readily installed and removed from the window frame. The mounting assembly includes a biased mount and a fixed mount, each attached to the panel in opposing relation to one another at about outer edges of the panel.

The biased mount has a body fixedly attached to a surface of the panel and includes a reciprocating biasing assembly carried by the body. The biasing assembly has a shaft operably connected to the body by a biasing element, such as a coil spring. The shaft has a first, preferably frictional engaging element mounted to an end thereof. The engaging element is movable away from and toward a respective one of the walls of the window frame and is engagable therewith. The biasing assembly biases the engaging element toward the wall.

The fixed mount also has a body fixedly attached to the surface of the panel in opposing, spaced relation to the biased mount. The mount is attached to the panel at about an opposing edge thereof. The fixed mount has a second, preferably frictional engaging element that is operably mounted thereto for engaging the other of the walls of the window frame, generally opposing the first engaging element.

When the panel is positioned at the window frame with the biased and fixed mounts engaging opposing walls of the window frame, the panel is secured in place between the walls by the first and second engaging elements in contact with their respective walls of the window frame and by a force exerted by the biasing element on the first engaging element.

In a preferred embodiment, the biased and fixed mount bodies each have a base portion attachable to the panel and at least one leg extending from the base portion. The leg defines an opening for receiving the shaft. Most preferably, the bodies are formed having a pair of legs extending from the base in opposing relation to one another defining a generally C-shaped body. Each C-shaped body forms an open central region bounded by the legs and the base, and each of the legs has an opening formed therein for receiving the shaft. The leg openings are aligned with one another. The biased mount has the spring positioned about the shaft within the open central region. Optionally, a spacer can be positioned between the spring and an inside surface of the leg.

Most preferably, the shaft includes a threaded portion and an adjusting element is positioned on the shaft, threadedly engagable with the shaft to precompress the spring and to limit travel of the shaft. To further facilitate adjustability, the engaging elements can be threadedly mounted to the shaft.

In a preferred embodiment of the fixed mount, the engaging element is adjustable relative to the leg to move the engaging element toward and away from the leg. Adjustability can be provided by threaded engaging elements threadedly engagable with the shaft for positioning and securing the shaft at a desired position.

Other features and advantages of the present invention will be apparent from the following detailed description, the accompanying drawings, and the appended claims.

BRIEF DESCRIPTION OF THE FIGURES

FIG. 3 is a partial cross-sectional view of the biased mount of FIG. 2. the mount being set to permit full travel of the biasing assembly shaft;

FIG. 4 is a partial cross-sectional view similar to FIG. 3, with the mount set for limited travel of the biasing assembly shaft;

FIG. 5 is a cross-sectional view of a fixed mount having a C-shaped body, the mount being illustrated with interior positioned adjusting nuts;

FIG. 6 is a front view of an alternate embodiment of the biased mount having a T-shaped mount body;

FIG. 7 is a front view of a fixed mount having a T-shaped mount body;

DETAILED DESCRIPTION OF THE PREFERRED EMBODIMENTS

Figure 1:
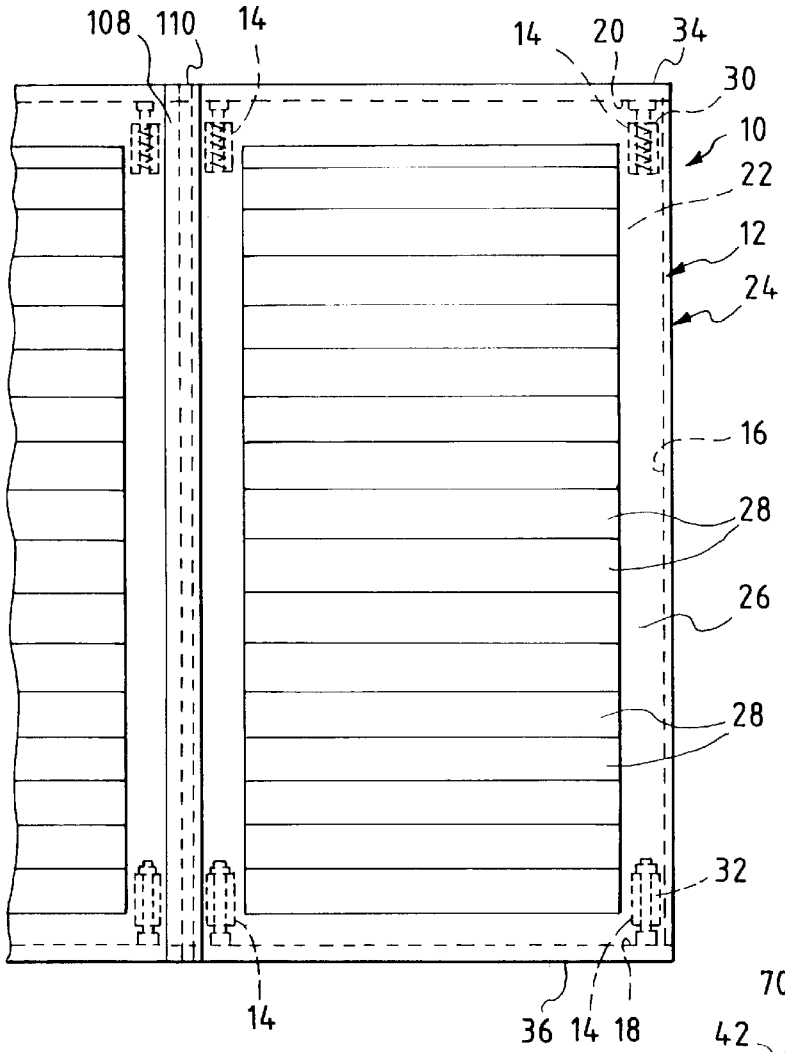
FIG. 1 is a partial front view of a multi-panel shutter configuration in an overlapping mount arrangement (relative to the window frame) installed using the shutter mounting assembly in accordance with the principles of the present invention, the biased and fixed mounts being vertically oriented and being illustrated in phantom lines.
Figure 2:
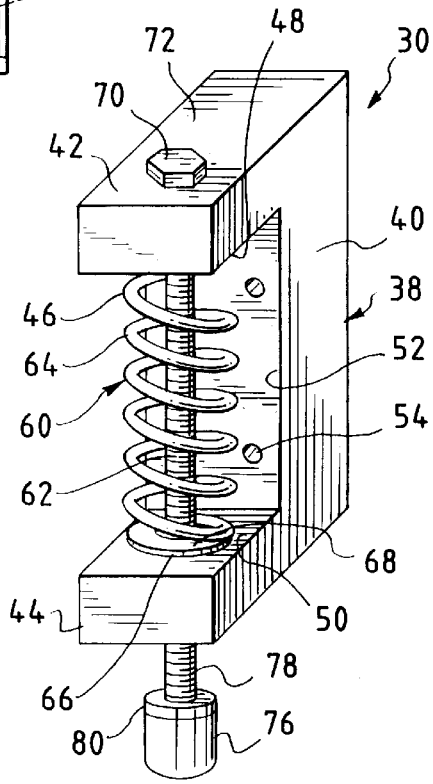
FIG. 2 is a perspective view of one embodiment of a biased mount having a C-shaped body that embodies the principles of the present invention.

While the present invention is susceptible of embodiment in various forms. there is shown in the drawings and will hereinafter be described presently preferred embodiments with the understanding that the present disclosure is to be considered an exemplification of the invention and is not intended to limit the invention to the specific embodiments illustrated.

Figure 8:
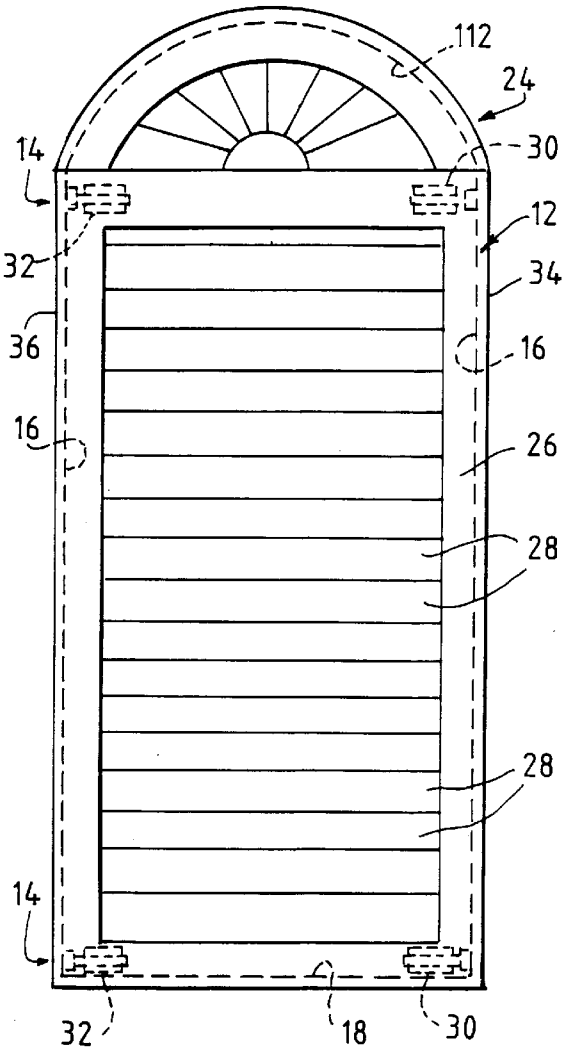
FIG. 8 is front view of a mounting arrangement that illustrates the present mounting assembly used with a circle-head window and matching shutter, the fixed and biased mounts being horizontally oriented.

Referring now to the figures and in particular to FIG. 1, there is shown a multi-panel installation, illustrated generally at 10, within a window box or window frame 12 (shown in FIG. 1 in phantom lines), using a mounting assembly 14 embodying the principles of the present invention. The mounting assembly 14 is illustrated mounting an exemplary shutter panel arrangement to the window frame 12. The window frame 12 includes a generally rectangular opening having a pair of parallel side walls 16 (one shown), a bottom wall or sill 18. and a top wall 20. The window frame 12 is generally formed in the same shape as the window 22 installed within it. To this end, the window frame 12 may include a semi-circular top portion 20 to accommodate, for example, a circle-head window 22, as illustrated in FIG. 8, which windows 22 have become quite popular and are in wide-spread use.

Shutters 24 can be installed in a variety of ways depending upon the aesthetics sought, and the window frame 12 design. Referring now to FIGS. 9A–B and 10A–C, shutters 24 can be installed overlapping one or more portions of the window frame 12, for example, overlapping the sill 18 or side walls 16 of the frame 12, or flush or recessed within one or more portions of the window frame 12.

As will be apparent from the figures and the following disclosure, the present shutter mounting system 14 provides a number of advantages over known mounting systems. First, the present mounting system 14 eliminates the need for a frame installed within or to the window frame onto which the shutters are otherwise mounted. This reduces the amount of material necessary for installing the shutters and greatly reduces the labor necessary for shutter installation. The present system also reduces the materials and time necessary for installing shutters by the "hanging-strip" method. In such a method, a hanging-strip is installed on an inner surface of the window frame and the shutters are mounted to the hanging-strip. In a typical hanging-strip installation, the shutters are mounted to the strip by hinges or the like. Again, the present shutter mounting system 14 reduces both the materials and labor necessary for such a hanging-strip installation.

A typical shutter 24 includes a frame 26 and a plurality of parallel, operably connected slats 28, that can be pivoted as a single unit, to adjust the amount of light filtering therethrough. It will however be recognized by those skilled in the art that a contemplated mounting system 14 can be used with other window "coverings" such as storm panels and the like. To this end, reference herein to shutter 24 shall be considered to include such other window "coverings" and the scope of the invention shall be construed commensurate therewith.

A contemplated shutter mounting assembly 14 permits the installation of shutters 24 in any manner, that is overlapping, recessed or flush, within most window frames 12. A shutter mounting assembly 14 includes an attached biased mount 30 and an attached fixed mount 32 that are positioned in opposing relation to one another relative to the shutter 24, proximal to respective, opposing outer edges 34, 36 of the shutter panel 24. For example, in the arrangement illustrated in FIG. 1, the biased and fixed mounts 30, 32 are positioned at the top and bottom of the shutter 24 and are oriented vertically in opposing relation to one another. That is, the biased mount 30, which is illustrated as the upper mount, is oriented upwardly into the window frame top 20, and the fixed mount 32, which is illustrated as the lower mount, is oriented downwardly into the window sill 18. Typically, the mounting assembly 14 is used with first and second mount pairs, each pair consisting of a biased mount 30 and a fixed mount 32, such as the arrangement illustrated in FIG. 1.

In one embodiment, as illustrated in FIGS. 3–4, the biased mount 30 includes a generally C-shaped body 38 having a base portion 40 and first and second parallel legs 42, 44 extending generally transversely from the base portion 40. The legs 42, 44 define an open central region (indicated at 46) therebetween that is bounded by interior surfaces of the legs and the base portion 48, 50, 52. The base 40 is configured for attaching to the shutter 24 and can include a plurality of openings 54 through the mount body 38 to secure or attach the mount 30 to the shutter 24 using, for example, fasteners such as screws (not shown).

The legs 42, 44 each include an opening 56, 58 therethrough, which openings 56, 58 align with one another. The openings are configured to receive a biasing assembly 60 that includes a shaft 62, such as the illustrated threaded bolt, a biasing element 64, an adjusting nut 66 and a spacer 68. Preferably, the bolt 62 includes a head or stop element 70. As shown, the bolt 62 is positioned in the mount 30, through the leg openings 56, 58, with the bolt head 70 engaging an outside surface 72 of the first leg 42. The biasing element 64, such as the illustrated coil spring is disposed around the bolt 62 in the open region 46 and rests against the inside surface 48 of the first leg 42 to define a bearing surface indicated at 74. Optionally, a washer or spacer (not shown) can be positioned between the spring 64 and the bearing surface 74. Biasing elements 64 other than the illustrated coil spring can be used to effectuate the biasing function, such as leaf-type springs and the like.

The adjusting nut 66 can be threaded onto the bolt 62, between the spring 64 and the second leg 44. The spacer 68, such as the washer shown in FIG. 3 can be positioned between the adjusting nut 66 and the spring 64. The adjusting nut 66 permits adjusting the force exerted by the spring 64 and thus the compressive force exerted by the biasing assembly 60 onto the window frame 12. Adjustment of the adjusting nut 66 also permits "setting" the amount of travel that the bolt 62 is permitted during use. A frame engaging element 76, such as a frictional pad, a rubber foot or cap or the like, is mounted to a free end 78 of the bolt 62. Preferably, the engaging element 76 is threadedly mounted to the bolt 62, such as by a threaded sleeve 80, to permit adjusting the position of the element 76 along the bolt 62.

As assembled, as best seen in FIGS. 3–4, the biased mount 30 biases the element 76 outwardly, away from the mount body 38 and into contact with the window frame 12. The element 76 can be urged inwardly toward the body 38 and against the bias by applying pressure on the element 76. Referring to FIG. 4, inward movement of the assembly 60; i.e., against the bias, is limited by complete compression of the spring 64 relative to the adjusting nut 66 and spacer 68. If it is desired to permit complete travel of the bolt 62, the adjusting nut 66 can be threaded along the bolt shaft 62 until it engages the inside surface 50 of the second leg 44, as illustrated in FIG. 3. Conversely, limiting travel of the bolt 62 is carried out by tightening down on the nut 66 (toward the first leg 42) and "pre-compressing" the spring 64 against the inner surface 48 of the first leg 42, as shown in FIG. 4.

Referring now to FIG. 5, the attached fixed mount 32 is similar to the biased mount 30 and includes a body 82 having a base portion 84 and first and second legs 86, 88 extending generally transversely from the base 84 to define an open central region 90. The base 84 includes fastener receiving openings 92 to secure or attach the fixed mount 32 to the shutter 24. The legs 86, 88 include openings 94 that align with one another and receive a threaded bolt 96 or like shaft element. A frame engaging element 98 such as a frictional pad, rubber foot or pad or the like, is fitted to a threaded end 100 of the bolt 96 for frictionally engaging the window frame 12.

One or more adjusting nuts 102, such as wing-nuts are positioned on the bolt 96 to adjust the length of the bolt 96 extending beyond the mount body 82. Preferably, two wing-nuts 102 are used and are positioned on the bolt 96 within the open central region 90 between the legs 86, 88. Alternately, the adjusting nuts 102 can be positioned to engage the outer surfaces 104, 106 of the legs 86, 88. This dual-nut 102 arrangement permits adjusting the distance between the engaging element 98 and the body 82 by loosening the adjusting nuts 102, setting a desired position of the element 98, and securing the bolt 96 in place by tightening both nuts 102 against their respective leg 86, 88 surfaces, as shown in FIG. 5. The engaging element 98 can be threadedly engaged onto the bolt 96 to provide additional adjusting capability. In both the biased and fixed mounts 30, 32, additional spacers or washers (not shown) can be used to prevent binding of the various components against the mount bodies 38, 82, and to distribute forces exerted by the various components on the mount bodies 38, 82 over larger areas of the bodies, to avoid localized high stresses in the body material.

In a preferred embodiment, the mount bodies 38, 82 are formed from a light-weight, high strength material. Most preferably, the material is a polymeric or like material that can be readily molded in, for example, an extrusion process. One preferred material is nylon, which can be molded, as well as machined; e.g., cut, drilled and finished. It will, however, be recognized by those skilled in the art that various other materials can be used, including extruded metals, such as aluminurn, as well as non-extrudable materials, such as wood.

In the embodiment of the biased and fixed mounts 30, 32 illustrated in FIGS. 2–5, covers (not shown) can be fitted to the mount bodies 38, 82 to cover the open central regions 46, 90 between the bodies' respective legs, to provide a more aesthetically pleasing appearance if, for example, the mounts can be seen from the rear of the shutter 24; e.g., from the outside. Such covers can also be formed to cover the entirety of the legs or the legs and the base portion.

It will be apparent from the figures that the present mounting assembly 14 provides a biased arrangement that permits compression of the biasing assembly 60 directly through pressure on the engaging element 76 thus compressing the spring 64. In this manner, when the shutter 24 is installed within the window frame 12, as illustrated in FIG. 1, the force of the spring 64 on the bolt 62 and thus the engaging element 76 results in a compression fit of the shutter 24 within the window frame 12.

Advantageously, the present arrangement also provides for "fine-tuned" fitting of the shutter 24 within the window frame 12 by threadedly adjusting the distance or extension of the element 76 of the biased mount 30 from the mount body 38 by use of the adjusting nut 66 and sleeve 80. Likewise, the fixed mount 32 can be adjusted by using the adjusting nuts 102 to adjust the distance between the element 98 and the fixed mount body 82. Thus, by adjusting both the biased and fixed mounts 30, 32, the shutter 24 can be fit; e.g., centered, within the window frame 12 as desired. Optionally, the fastener openings 54, 92 can be slotted or elongated (not shown) to further permit adjustment of the mounts 30, 32 relative to the shutter edges 34, 36.

One use of the present shutter mounting system 14 is illustrated in FIG. 1. In this arrangement, the biased and fixed mounts 30, 32 are positioned at the top and bottom of the shutter 24 with the mounts 30, 32 oriented vertically, opposing one another. In this manner, the mounts 30, 32 are configured to engage the bottom or sill portion 18 of the window frame 12 and a top, inner surface 20 of the frame 12. In the illustrated arrangement, shutter panels 24 are positioned side-by-side in the window frame 12. The present mounting assembly 14 permits such side-by-side mounting without the use of a large frame structure to support the shutters or hinges or other devices connecting the shutters to one another to support them within the window frame. If desired, an astragal 108 can be positioned at the vertical edge 110 of the shutter panel 24 where it abuts another shutter panel 24 to hide any gaps that may exist between the panels.

An alternate arrangement for shutter mounting is illustrated in FIG. 8. In this figure, the mounts 30, 32 of each pair are positioned generally horizontally coplanar with one another, with one pair preferably being positioned at about, and secured or attached to an upper portion of the shutter 24, and another pair being positioned at about and secured or attached to a lower portion of the shutter 24. The pairs of mounts 30, 32 are oriented horizontally to engage the side walls 16 of the window frame 12. This configuration permits use of the present mounting system 14 in window frames 12 that may include, for example, semi-circular upper walls 112 above or as part of a rectangular window such as the illustrated circlehead window.

Figure 9B:
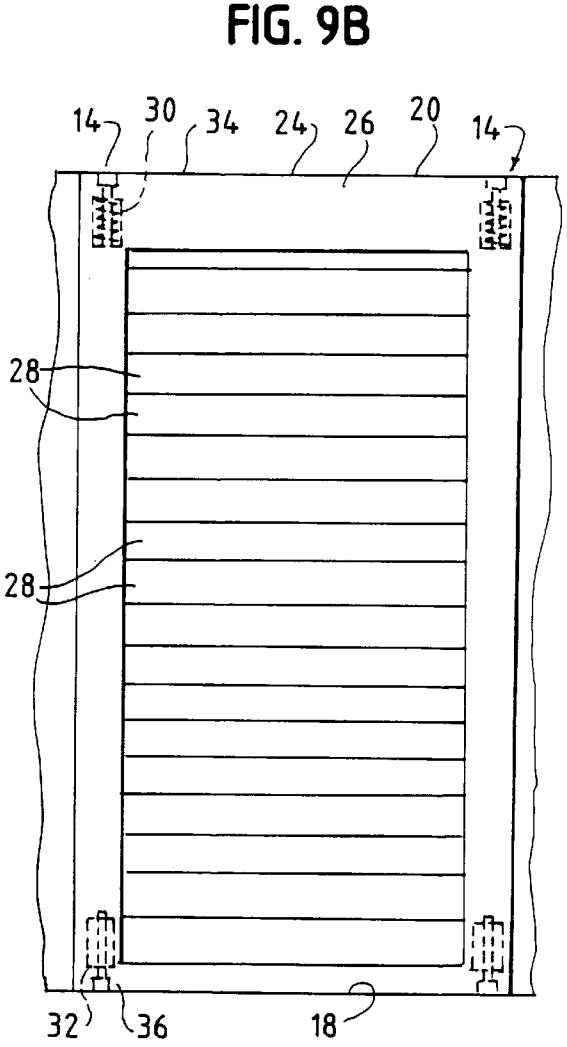
FIGS. 9A and 9B are front views of the present mounting assembly used to mount shutters in an ovrlapping configuration (FIG. 9A) and a flush or recessed configuration (FIG. 9B)
Figure 9A:
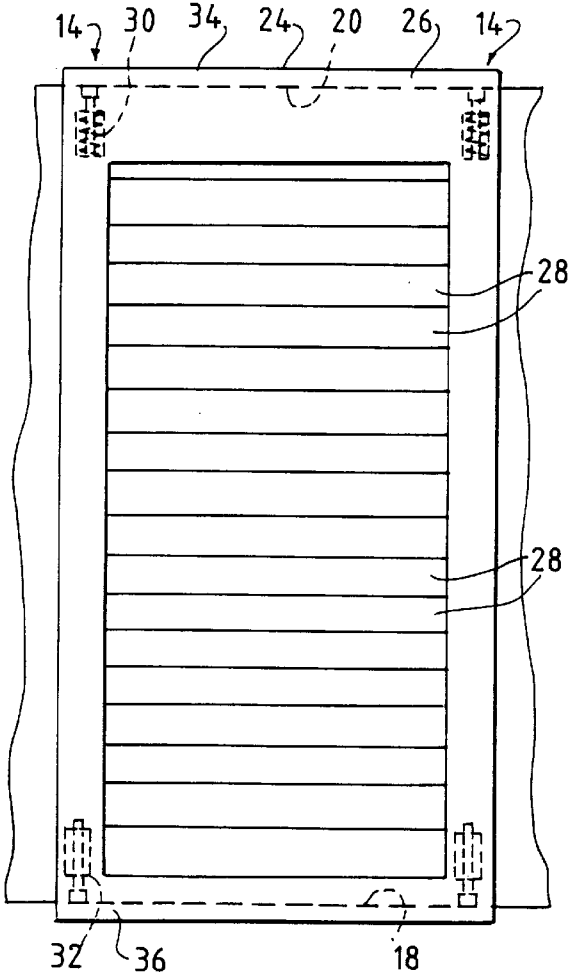
Figure 10A:
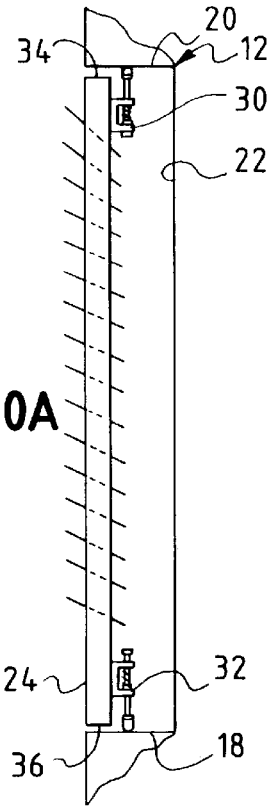
FIGS. 10A–10D illustrate side views of exemplary arrangements in which shutters can be installed relative to a window frame, FIG. 10A illustrating a flush mount, FIG. 10B illustrating a recessed mount, FIG. 10C illustrating an overlapping mount and FIG. 10D illustrating a flush mount similar to FIG. 10A, with optional trim mounted to the shutter.
Figure 10B:
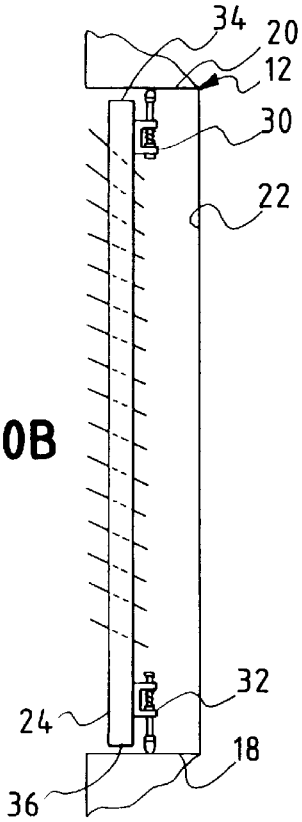
Figure 10C:
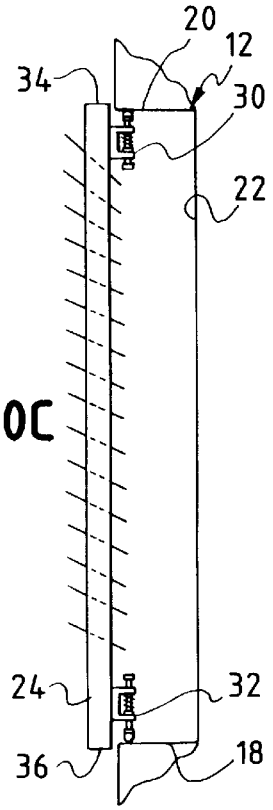
Figure 10D:
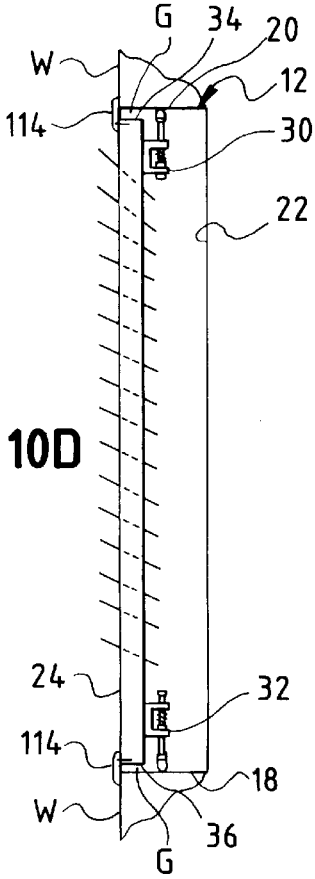

As previously discussed, the present shutter mounting assembly 14 provides considerably more flexibility in shutter layout and design than known shutter mounting configurations. As best seen in FIGS. 9A–B and 10A–C, shutters 24 can be installed flush with one or more of the walls adjacent the window frame 12 as illustrated in FIGS. 9B and 10A, recessed within the window frame 12 as illustrated in FIG. 10B or overlapping one or more of the walls adjacent the window frame 12 as illustrated in FIGS. 9A and 10C. As seen in FIG. 10D, optional trim elements 114, such as casing, can be mounted to the panel 24, extending over the edges, 34, 36 to cover any gaps G that may exist between the panel 24 and the wall W (or portion of the window frame 12) adjacent thereto. The trim 114 can be mounted to the panel 24 by fasteners such as nails, screws or the like. It may also be desirable to mount the trim 114 to the panel so as to be readily removable by, for example, a hook and loop mechanical fastening material, such as VELCRO®.

As will be apparent from the drawings, and as will be recognized by those skilled in the art, the walls surrounding a window frame 12 may not always be coplanar with one another. That is, the sill portion 18 of the frame 12 may extend outwardly from the other wall surfaces around the window frame 12. The present shutter mounting assembly 14 permits mounting shutters 24 within such window frame 12 configurations, because any of the mount 30, 32 arrangements; i.e., flush recessed and overlapping, can be used with any of the other arrangements. For example, in a shutter arrangement, the top T of the shutter 24 can be mounted flush with the wall above the window frame 12, whereas the bottom B of the shutter 24 can be recessed along the window sill 18. This flexibility provides many benefits over known shutter mounting arrangements, and permits shutter installation that accommodates a variety of window constructions.

An alternate embodiment of shutter mounts 210, 212 is illustrated in FIGS. 6–7. In this embodiment, the biased 210 and fixed 212 mounts are formed having generally T-shaped bodies 214, 216 each having a base portion 218, 220 and a leg portion 222, 224. The legs 222, 224 each include a bore 226 that is configured to receive a bolt 228, 230 therethrough. A biasing assembly 232 includes a biasing element 234 such as the illustrated coil spring that is positioned on the bolt 228, that directly or indirectly (such as by an intermediately positioned washer) engages a wall 236 of the leg 222.

A spacer 238 and an adjusting nut 240 are positioned on the bolt 228 in opposing relation to the leg 222, to retain the spring 234 in place on the bolt 228. Travel of the bolt 228 in the biased mount 210 can be adjusted by threading the adjusting nut 240 along the bolt 228 to a desired, set length. A frame engaging element 242 such as a frictional rubber pad or foot is positioned on an end of the bolt 228. Preferably, the element 242 is mounted to the bolt 228 by a threaded sleeve 244 to permit further adjustment of the element 242 relative to the mount body 214.

The fixed mount 212 is similar to the biased mount 210. A bolt 246 is fixedly positioned relative to the leg 244 by a pair of adjusting nuts 248, 250, as shown in FIG. 7. In this manner, the distance between the element 242 and the leg 224 can be adjusted to set the element 242 at a desired distance.

Other configurations for the mount body can also be used. For example, a body having a generally L-shaped cross-section (not shown) can be used. In this embodiment, one leg of the "L" is used to attach the body to the shutter, and the other leg is used to receive the bolt. Those skilled in the art will recognize that various other cross-sectional shapes can be used for the mount body, which other body shapes are within the scope of the present invention. It will also be apparent from the drawings and the present disclosure that other components can be used in the present mounts. For example, additional washers or spacers can be used to reduce or eliminate binding of the threaded fasteners; e.g., adjusting nuts, onto the various mount body surfaces to reduce the opportunity to wear away these surfaces. These other or additional components are also within the scope of the present invention.

As discussed herein, the present shutter mounting system 14 provides a number of advantages over known mounting systems. For example, the present mounting system 14 eliminates the need for a frame installed within or to the window frame onto which the shutters are otherwise mounted. This reduces the amount of material necessary for installing the shutters and greatly reduces the labor necessary for shutter installation. The present system also reduces the materials and time necessary for installing shutters by the "hanging-strip" method.

In addition, the present shutter mounting system 14 also provides advantages over known permanent mount arrangements. In one known arrangement, shutters are permanently attached to an inside surface of the window frame. It will be apparent that in such an arrangement, access to the area between the shutter and the window can be greatly reduced or restricted. To this end, it may be difficult or even impossible to clean the interior surfaces of the window or otherwise perform maintenance around, for example, the window seals. Advantageously, the present arrangement permits readily removing the shutter 24 from the window frame 12 merely by exerting pressure against the bias of the biased mounts 30, 210 and subsequently moving the fixed mounts 32, 212 away from or out of the window frame 12. In this manner, shutters 24 that are installed using the present mounting system 14 can be readily removed from the window frame 12 to clean or perform maintenance around the window 22. Re-installation of the shutter 24 is readily accomplished by positioning the shutter 24 appropriately within the window frame 12, applying pressure on the shutter 24 against the bias of the biased mounts 30, 210, and positioning the fixed mounts 32, 212 in the appropriate location.

From the foregoing, it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appending claims all such modifications as fall within the scope of the claims.

What is claimed is:

1. A removable panel mountable adjacent and in parallel, spaced relation to an associated window set into an associated window frame, the associated frame having associated first and second opposing walls, the removable panel comprising:

a panel having first and second spaced apart, parallel edges and defining a surface;

a biased mount having a body fixedly attached to the surface of the panel proximal to one of the first and second edges, the biased mount including a reciprocating biasing assembly carried by the body, the biasing assembly having a shaft operably connected to the body by a biasing element, the shaft having a first engaging element mounted to an end thereof, the engaging element being movable away from and toward a selected one of the associated first and second walls of the associated window frame and engagable therewith, the biasing assembly biasing the engaging element toward the associated selected wall; and a fixed mount having a body fixedly attached to the surface of the panel in opposing, spaced relation to the biased mount and proximal to the other of the first and second edges of the panel the fixed mount having a second engaging element operably mounted thereto for engaging the other of the associated first and second walls of the associated window frame in a direction generally opposing the first engaging element, the biased and fixed mounts being longitudinally opposingly oriented relative to one another, wherein when the panel is positioned at the associated window frame with the biased and fixed mounts engaging opposing associated walls of the associated window frame, the panel is secured in place between the associated walls by the first and second engaging elements in contact with their respective associated walls of the associated window frame and by a force exerted by the biasing element on the first engaging element.

2. The removable panel in accordance with claim 1 wherein the panel is a shutter.

3. The removable panel in accordance with claim 1 wherein the panel has first and second opposing side edges and wherein the fixed and biased mounts are attached to the panel proximal to the side edges in opposing relation to one another.

4. The removable panel in accordance with claim 1 wherein the panel has top and bottom edges and wherein the fixed and biased mounts are attached to the panel in opposing relation to one another proximal to a respective one of the top and bottom edges.

* * * * *